US009996994B2

(12) United States Patent
Leconte

(10) Patent No.: US 9,996,994 B2
(45) Date of Patent: Jun. 12, 2018

(54) ELECTRONIC COMMUNICATION MODULE FOR LOCKING/UNLOCKING A MOVABLE PANEL OF A MOTOR VEHICLE, ASSOCIATED CONTROL CENTRAL PROCESSING UNIT, AND HANDS-FREE ACCESS SYSTEM

(75) Inventor: Eric Leconte, Creteil (FR)

(73) Assignee: VALEO SECURITE HABITACLE, Créteil (FR)

( * ) Notice: Subject to any disclaimer, the term of this patent is extended or adjusted under 35 U.S.C. 154(b) by 793 days.

(21) Appl. No.: 13/993,120

(22) PCT Filed: Dec. 14, 2011

(86) PCT No.: PCT/EP2011/072749
§ 371 (c)(1),
(2), (4) Date: Nov. 27, 2013

(87) PCT Pub. No.: WO2012/080328
PCT Pub. Date: Jun. 21, 2012

(65) Prior Publication Data

US 2014/0077926 A1 Mar. 20, 2014

(30) Foreign Application Priority Data

Dec. 15, 2010 (FR) ..... 10 04895

(51) Int. Cl.
*G07C 9/00* (2006.01)

(52) U.S. Cl.
CPC ..... *G07C 9/00111* (2013.01); *G07C 9/00309* (2013.01); *G07C 2009/00373* (2013.01); *G07C 2209/65* (2013.01)

(58) Field of Classification Search
None
See application file for complete search history.

(56) References Cited

U.S. PATENT DOCUMENTS 4,942,393 A * 7/1990 Waraksa et al. ..... 340/5.62
5,144,667 A * 9/1992 Pogue et al. ..... 380/45
(Continued)

FOREIGN PATENT DOCUMENTS

DE 100 04 616 A1 8/2001
DE 10 2006 026564 A1 12/2007
(Continued)

OTHER PUBLICATIONS

International Search Report issued in PCT/EP2011/072749 dated Mar. 16, 2012 (6 pages).
(Continued)

*Primary Examiner* — K. Wong
(74) *Attorney, Agent, or Firm* — Osha Liang LLP

(57) ABSTRACT

The invention relates to an electronic communication module (2) for locking/unlocking at least one movable panel of a motor vehicle, including a resonant circuit adjusted to a timing frequency and including an transmission winding (20) connected in series to a tuning capacitor (21), said resonant circuit (20, 21) being capable of emitting a low-frequency interrogation signal, at said tuning frequency, to a portable badge or identifier, and a manually-actuated triggering member (22), the actuation of which triggers the transmission of said interrogation signal. According to the invention, the triggering member is a button switch (22) connected in series to at least one resistor (23) in order to form an electric dipole (24), and said electric dipole (24) is electrically connected in parallel to all or part of the resonant circuit (20, 21). The invention also relates to a central processing unit (3) for controlling said module through two electrical connection wires (4, 5), and to an associated hands-free access system.

14 Claims, 3 Drawing Sheets

(56) References Cited

U.S. PATENT DOCUMENTS

| | | | | |
|---|---|---|---|---|
| 5,978,483 | A * | 11/1999 | Thompson et al. | 380/262 |
| 6,401,207 | B1 * | 6/2002 | Funakoshi et al. | 713/182 |
| 7,129,815 | B2 * | 10/2006 | Morrison et al. | 340/5.25 |
| 7,716,013 | B2 * | 5/2010 | Orth | A41D 13/005 135/91 |
| 7,961,077 | B2 * | 6/2011 | Watanabe et al. | 340/5.8 |
| 2003/0001396 | A1 | 1/2003 | Jooss et al. | |

FOREIGN PATENT DOCUMENTS

| | | | |
|---|---|---|---|
| EP | 1 213 687 | A1 | 6/2002 |
| EP | 1 700 390 | A1 | 9/2006 |
| FR | 2 921 958 | A1 | 4/2009 |
| JP | 2007-104146 | A | 4/2007 |
| JP | 2007-162246 | A | 6/2007 |
| JP | 2010-229798 | A | 10/2010 |
| WO | 2005/062483 | A1 | 7/2005 |

OTHER PUBLICATIONS

Office Action dated Jan. 12, 2015 in corresponding Chinese Patent Application No. 201180067673.3 (21 pages).
Office Action dated Sep. 25, 2015, in corresponding Japanese Patent Application No. 2013-543755 (10 pages).

* cited by examiner

ELECTRONIC COMMUNICATION MODULE FOR LOCKING/UNLOCKING A MOVABLE PANEL OF A MOTOR VEHICLE, ASSOCIATED CONTROL CENTRAL PROCESSING UNIT, AND HANDS-FREE ACCESS SYSTEM

The present invention concerns an electronic communication module for locking/unlocking at least one movable panel of a motor vehicle and a control central processing unit of a hands-free access system for controlling such an electronic communication module. The invention also concerns a hands-free access system including such an electronic communication module and its associated control central processing unit.

Motor vehicle hands-free access systems are designed so that a user carrying an identification device (badge or other portable identifier) can unlock and/or lock their vehicle without having to manipulate a key or remote controller. In such an access system, a part of the system on the vehicle includes communication means adapted to communicate with the identification device by exchanging electromagnetic signals with a view to authentication prior to an actual request to unlock/lock at least one movable panel of the vehicle.

In this type of system, authentication includes a first interrogation step during which the communication means transmit a low-frequency interrogation signal in the immediate vicinity of the vehicle. If a badge is present in that vicinity, it sends back a response signal, preferably a radio-frequency signal, to enable its authentication.

To prevent excessive energy consumption, the transmission of the interrogation signal is preferably triggered only if the system has first been able to sense the presence of the user. Thus it is known to place on the movable panel of the vehicle, preferably in the handle of the movable panel, a capacitive sensor used as a proximity sensor or touch sensor. When the user moves their hand toward the handle or touches the sensor to open the door, their presence is sensed and interrogation is triggered so that, in the event of positive authentication, the door is unlocked when the user pulls the handle to open it. Some systems even add a capacitive proximity sensor for unlocking and a capacitive touch sensor for locking.

Other systems use a manually operated pushbutton switch situated on or near the handle to enable triggering of transmission of the interrogation signal in order to unlock and/or unlock the movable panel.

There are also known already hands-free access systems in which the means for transmitting the low-frequency interrogation signal and the presence sensing means (sensors and/or pushbutton switch) are combined in one and the same electronic communication module, designed to be integrated into the movable panel, preferably into the handle of the movable panel. In this case, the elements of the system necessary for generating the low-frequency interrogation signal and for powering and controlling the electronic communication module are preferably sited remotely from the module and combined into a control central processing unit inside the vehicle. The control central processing unit is connected to the electronic communication module via an electrical connecting harness comprising a plurality of wires.

In this type of architecture, it is important to be able to find solutions that make it possible to minimize the number of wires in the connecting harness needed to connect the electronic communication module and the control central processing unit. Such a harness with a plurality of wires, generally copper wires, has high material and labor costs in terms of manufacture, and also in terms of installation and vehicle maintenance.

Some solutions have already been proposed in the case of an electronic communication module incorporating two capacitive sensors, namely a proximity sensor to enable unlocking and a touch sensor to enable locking. Thus the document EP 1 700 390 B1 describes an architecture in which the low-frequency transmission antenna is connected in parallel with the capacitive sensors at the level of the electronic communication module and in which the two wires of a connecting harness necessary for supplying DC power to the sensors are used to control the transmission antenna and carry the interrogation signal to be transmitted.

Nevertheless, at present, no solution has as yet been proposed to enable the number of wires to be reduced when the electronic communication module incorporates a manually operated pushbutton switch instead of two capacitive sensors.

An object of the present invention is to alleviate this.

To this end, a first aspect of the present invention consists in an electronic communication module for locking/unlocking at least one movable panel of a motor vehicle, including a resonant circuit tuned to a tuning frequency and including a transmission coil in series with a tuning capacitor, said resonant circuit being adapted to transmit a low-frequency interrogation signal at said tuning frequency to a badge or portable identifier, and a manually actuated triggering device, actuation of which is employed to trigger the transmission of said interrogation signal, characterized in that the triggering device is a pushbutton switch connected in series at least with a resistor to form an electrical dipole and said electrical dipole is electrically connected in parallel with all or part of the resonant circuit.

Thanks to these features, only two connecting wires for supplying power to the module are needed to command transmission of the interrogation signal following manual actuation of the pushbutton switch and because of the presence of the resistor the operation of the resonant circuit does is not much degraded if the pushbutton switch is pressed for a long time.

In accordance with possible other additional features of the module:

- said electrical dipole is electrically connected either to the terminals of the tuning capacitor or to the terminals of the resonant circuit as a whole;
- the electronic communication module is adapted to be integrated into a handle of a movable panel of the vehicle;
- the electronic communication module includes a single printed circuit on which said resonant circuit and the electrical dipole are mounted;
- alternatively, the electronic communication module includes a single printed circuit on which only the electrical dipole and the tuning capacitor are mounted;
- another alternative is for the electronic communication module to include a single printed circuit on which only the resonant circuit and said resistor are mounted;
- the electrical dipole may advantageously include an additional inductor in series with the resistor and the pushbutton switch.

A second aspect of the present invention consists in a control central processing unit of an electronic communication module adapted to transmit a low-frequency interrogation signal to a badge or portable identifier, characterized in that it is adapted to control the electronic communication module in accordance with the invention via an electrical connecting harness with two wires.

In a preferred embodiment, the control central processing unit includes:

- a low-frequency voltage generator adapted to be electrically connected to the terminals of the resonant circuit of the electronic communication module via the two wires of the connecting harness for the transmission of said interrogation signal;
- a connection to a DC electrical power supply adapted to connect the electronic module to said supply via a first wire of the two wires of the connecting harness;
- a sensing circuit adapted to deliver an output signal representing the open or closed state of the pushbutton switch; and
- a microcontroller receiving the output signal of the sensing circuit and adapted, when the sensing circuit delivers an output signal representing the closed state of the pushbutton switch, to command the generation by the low-frequency voltage generator of a low-frequency signal for energization of the resonant circuit.

For example, the sensing circuit includes means, typically a current mirror, for measuring the current flowing between said first wire and the connection to the DC power supply adapted to deliver an output voltage representing said current and a two-input voltage comparator adapted to compare said output voltage with a reference voltage and to deliver said output signal as a function of the comparison. In this case, the central processing unit preferably includes switch means in series with the current measuring means and the microcontroller is adapted to command opening or closing of the switch means according to whether the pushbutton switch is in the closed or open state, respectively.

Alternatively, the sensing circuit may include a resistor in series between the first wire and the connection to the DC power supply and a two-input voltage comparator adapted to compare a voltage at the terminals of the resistor to a reference voltage and to deliver said output signal as a function of the comparison.

A final aspect of the present invention consists in a motor vehicle hands-free access system including a communication module adapted to transmit a low-frequency interrogation signal to a badge or portable identifier and a central processing unit for controlling the communication module, characterized in that said communication module is an electronic communication module in accordance with the invention, the central processing unit is a control central processing unit in accordance with the invention, and the system further includes an electrical connecting harness with two wires electrically connecting said control central processing unit to said electronic communication module.

The invention and the advantages that it procures will be better understood in the light of the following nonlimiting description with reference to the appended figures, in which.

Figure 1:
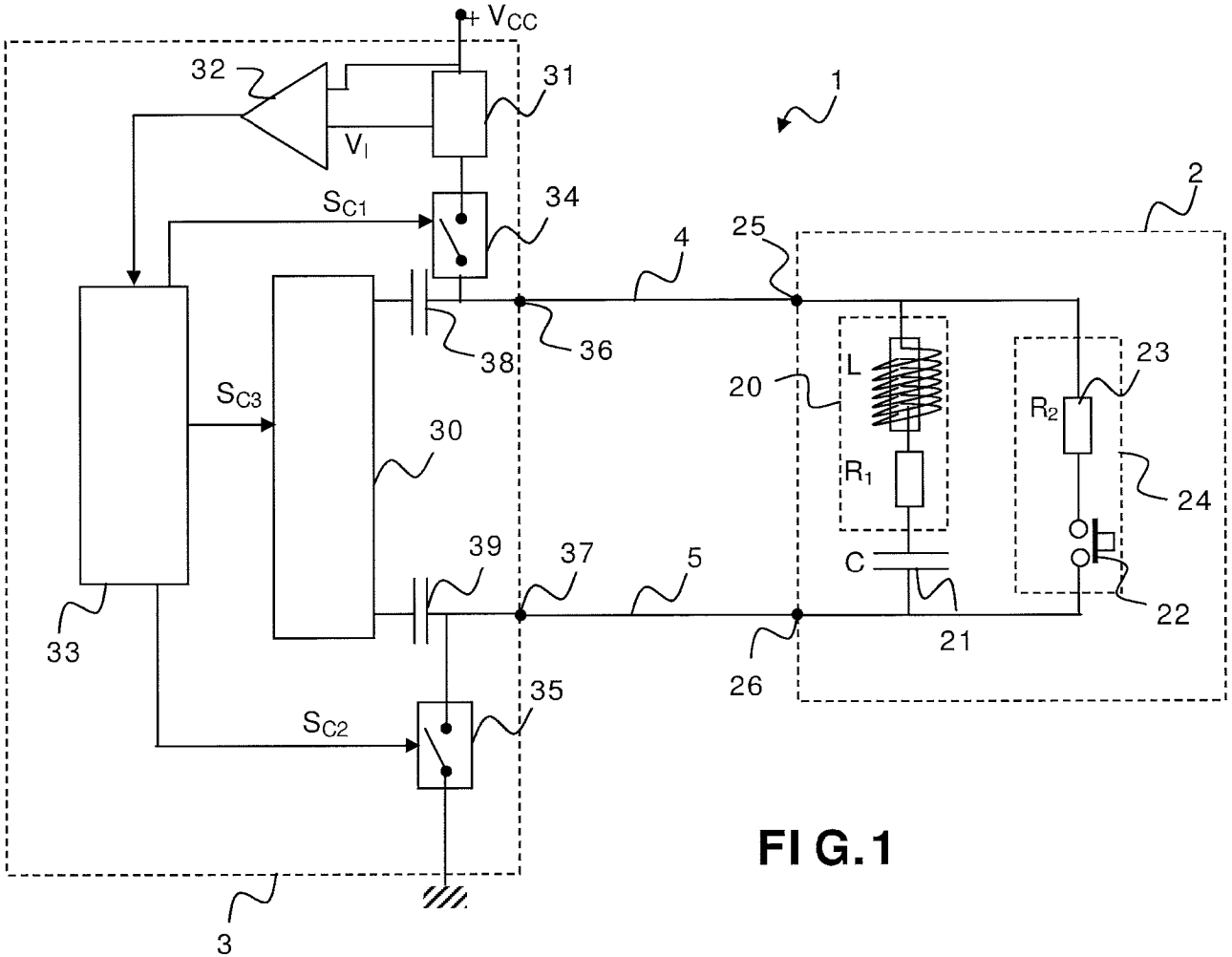
FIG. 1 shows a hands-free access system including an electronic communication module conforming to a first embodiment of the invention.

Referring to all of the appended figures, a hands-free access system 1 in accordance with the present invention includes an electronic communication module 2 adapted to transmit a low-frequency interrogation signal to a badge or portable identifier (not represented) and a central processing unit 3 adapted to control the electronic control module 2. The system further includes an electrical connecting harness with two wires 4, 5 electrically connecting the control central processing unit 3 to the electronic communication module 2.

In the three figures, the electronic control module 2 is used for locking/unlocking at least one movable panel of a motor vehicle and to this end conventionally includes a resonant circuit tuned to a tuning frequency and including a transmission coil 20 wound around a ferrite core (represented here by the series combination of an inductor L and a resistor $R_1$) in series with a tuning capacitor 21. The resonant circuit 20, 21 is therefore able, under the control of the central processing unit 3 as explained later, to transmit a low-frequency interrogation signal at said tuning frequency (typically of the order of 125 kHz) to any badge or portable identifier present in the transmission area associated with the resonant circuit forming the low-frequency transmission antenna. The module 2 further includes a manually operated triggering device actuation of which triggers the transmission of said interrogation signal. In a first variant of the invention, the triggering device is a pushbutton switch 22 connected in series at least with a resistor 23 to form an electrical dipole 24 electrically connected in parallel with the resonant circuit as a whole.

Figure 2:
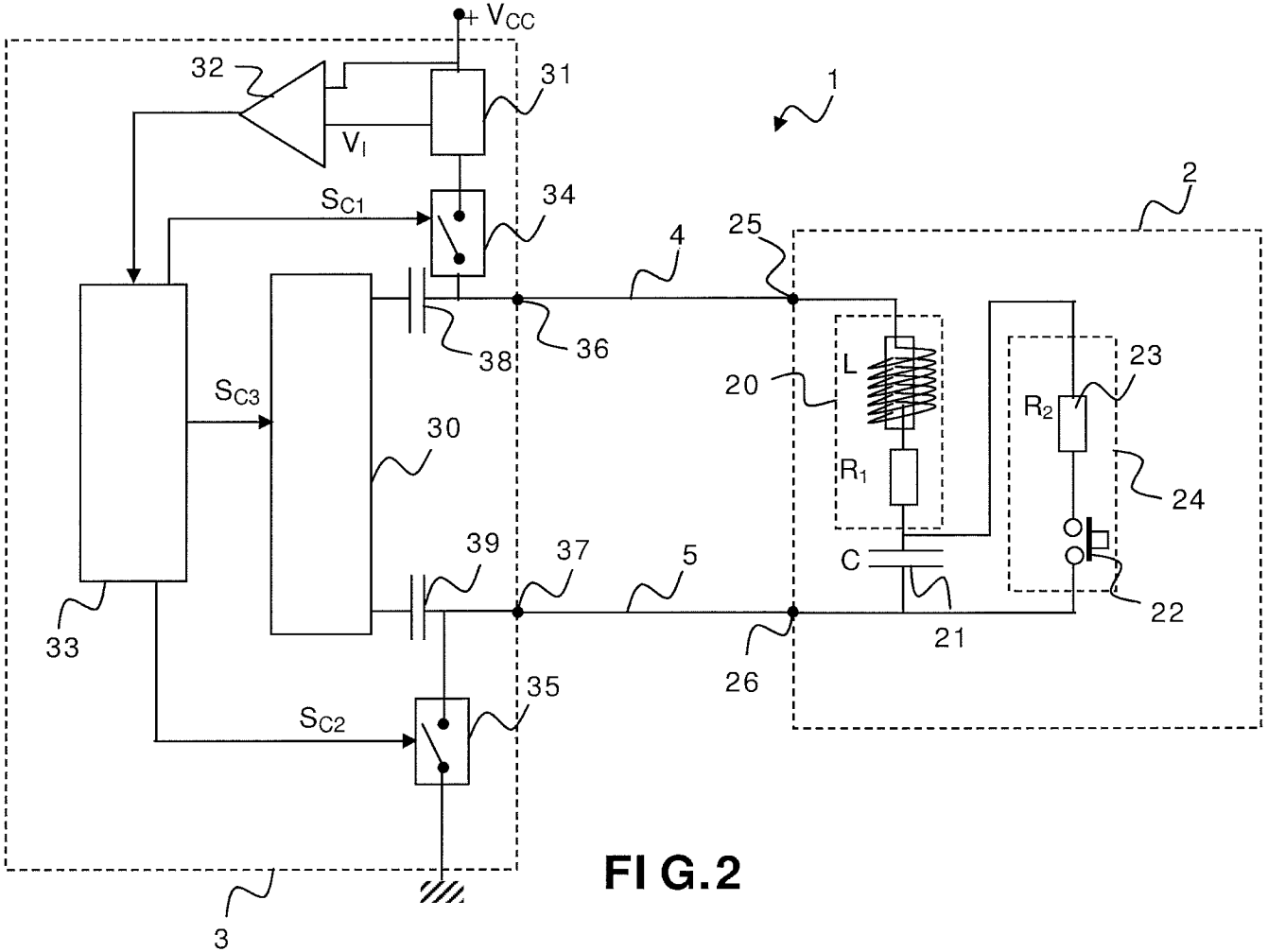
FIG. 2 shows a variant of the hands-free access system including an electronic communication module conforming to a second embodiment of the invention.
Figure 3:
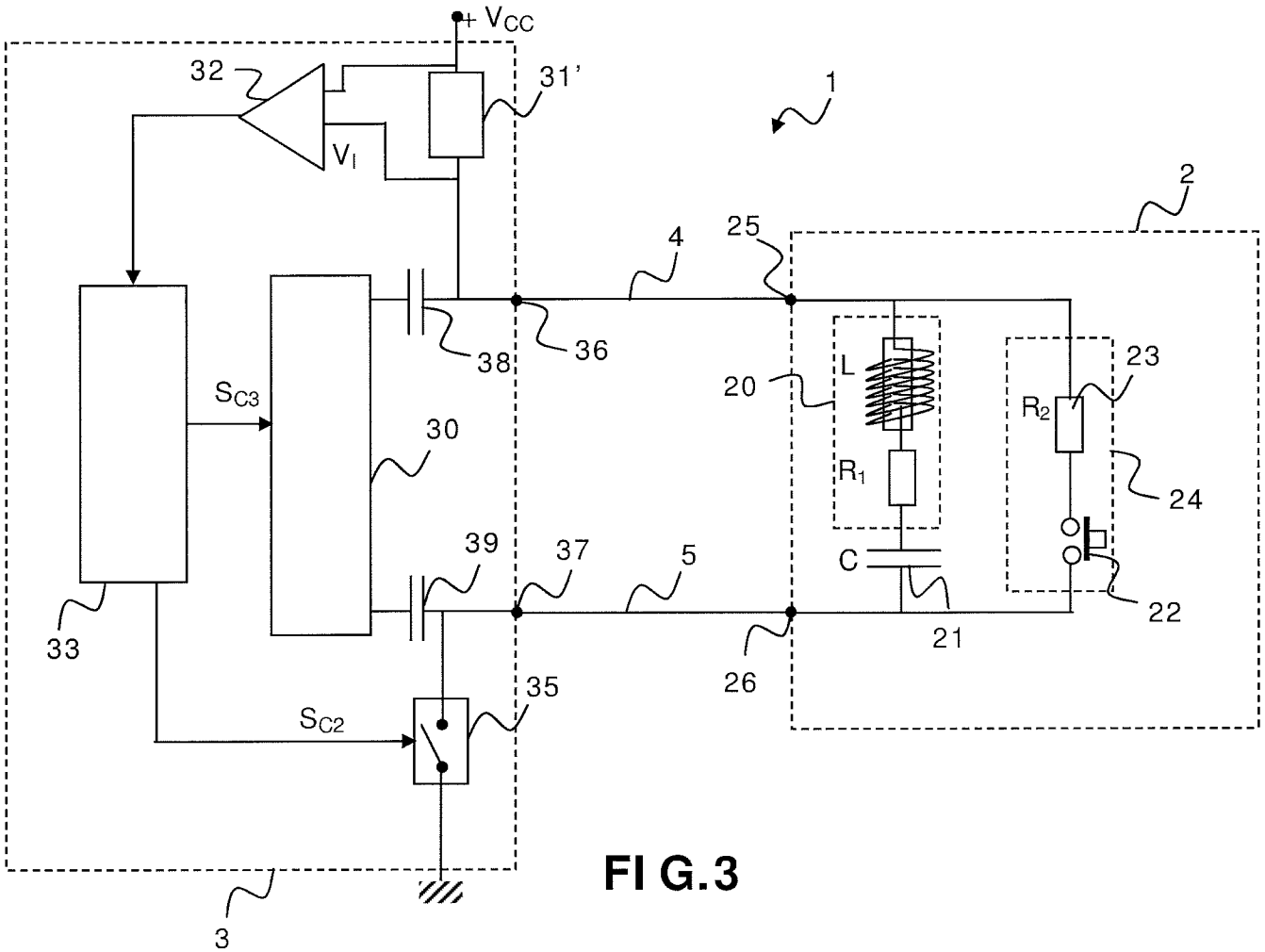
FIG. 3 shows a variant of the control central processing unit in a hands-free access system in accordance with the invention.

Alternatively, as represented in FIGS. 2 and 3, the electrical dipole 24 is electrically connected in parallel with only part of the resonant circuit, in particular connected to the terminals of the tuning capacitor 21.

In both cases, the presence of the resistor 23 in the electrical dipole 22 makes it possible to reduce the nuisance effect of a user pressing the pushbutton switch 22 for a long time with the resonant circuit activated to transmit the interrogation signal.

To reduce further any risk of such nuisance effect, an additional inductor (not represented) may advantageously be incorporated into the electrical dipole, in series with the resistor 23 and the pushbutton switch 22, to enhance the filtering of the low frequency.

Thanks to these features, a compact module is obtained that can easily be integrated into the handle of a movable panel of the vehicle, for example, with only two connecting terminals 25, 26 for connecting the module 2 to the control central processing unit 3 via the two wires 4 and 5, respectively.

The various components used in the module 2 may be incorporated in various ways:

In a first embodiment, the electronic communication module includes a single printed circuit board (not represented) on which all the components are mounted, namely on the one hand the components of the resonant circuit and on the other hand the components of the electrical dipole 24.

Alternatively, the module 2 includes a single printed circuit board (not represented) on which only the electrical dipole 24 and the tuning capacitor 21 are mounted. In this case the coil 20 is electrically connected to the printed circuit board without being supported on it. This arrangement offers greater flexibility for installing the coil 20.

In a further variant, only the resonant circuit and the resistor 23 (and the optional additional inductor referred to above) are mounted on the same printed circuit board. This third variant advantageously makes it possible to manage diversities, notably so that only certain modules, for example that intended to equip the driver's side movable panel, actually include all of the components, while other modules, which are intended to equip the other movable panels of the vehicle, comprise only the pushbutton switch.

Whichever variant is adopted for the communication module as shown in FIGS. 1 to 3, the control central processing unit 3, the construction of which is to be described next, is able to control this electronic communication module 2 via the two wires 4, 5 of the electrical connecting harness on the one hand to sense actuation of the pushbutton switch and on the other hand to trigger the transmission of the low-frequency interrogation signal.

To this end, and as represented in each of FIGS. 1 to 3, the central processing unit 3 includes:

- a low-frequency voltage generator 30 adapted to be electrically connected to the terminals 20, 21 of the resonant circuit of the electronic communication module via the two wires 4, 5 of the connecting harness for the transmission of said interrogation signal;
- a connection to a DC electrical power supply $+V_{cc}$ adapted to connect a first of the two wires of the connecting harness, here the wire 4, to the DC power supply $+V_{CC}$;
- a sensing circuit (31, 32 in FIGS. 1 and 2 and 31', 32 in FIG. 3) adapted to deliver an output signal representing the open or closed state of the pushbutton switch 22 whatever the value of the DC voltage $+V_{CC}$; and
- a microcontroller 33 receiving the output signal of the sensing circuit and adapted, when the sensing circuit senses a closed state of the pushbutton switch, to command generation by the low-frequency voltage generator 30 of a low-frequency signal for energization of the resonant circuit and thereafter transmission of the interrogation signal.

The DC power supply $+V_{CC}$ is typically the battery of the vehicle.

In the embodiments represented in FIGS. 1 and 2, the sensing circuit includes on the one hand current measuring means 31, for example a current mirror, adapted to measure the current flowing between the first wire 4 and the terminal connected to the DC power supply $+V_{CC}$ and to deliver an output voltage $V_I$ representing this current and on the other hand a two-input voltage comparator 32 receiving the voltage $V_I$ delivered at the output of the current measuring means 31 and a reference voltage, for example the supply voltage $+V_{CC}$, and delivering the output signal representing the open or closed state of the pushbutton switch 22.

The central processing unit 3 preferably further includes:

- first switch means 34 in series with the current measuring means 31 opened or closed by a first control signal $S_{C1}$ delivered by the microcontroller 33;
- second switch means 35 between the second wire 5 and ground opened or closed by a second control signal $S_{C2}$ delivered by the microcontroller 33.

When the switch means 34, 35 are closed, the module 2 is connected to the DC power supply via the first wire 4 and to ground via the second wire 5. When the switch means 34, 35 are open, the module 2 is connected only to the low-frequency voltage generator 30.

When the system is idle, i.e. awaiting possible manual actuation of the pushbutton switch, the microcontroller 33 activates the connection of the wire 4 to the DC power supply $+V_{CC}$, the other connecting wire 5 being connected to ground. The switch means 34, 35 are therefore commanded to the closed position by the control signals $S_{C1}$ and $S_{C2}$, respectively.

If the user has not pressed the pushbutton switch 22, no current flows in the wire 4 with a result that the voltage $V_I$ at the output of the current measuring means 31 is zero.

When the pushbutton switch is pressed, the current I flowing in the resistor 23 of value $R_2$, and consequently the wire 4, is given by the equation:

$$I=+V_{CC}/R_2$$

and the current measuring means 31 deliver a voltage $V_I$ proportional to this current I.

The output of the comparator 32 delivered to the microcontroller 33 is therefore, according to the result of this comparison, an accurate reflection of either the open state or the closed state of the pushbutton switch 22.

As soon as the sensing circuit senses a closed state of the pushbutton switch, the microcontroller 33 commands disconnection of the module 2, typically disconnection of the first wire 4, from the DC power supply $+V_{CC}$ by means of the control signals $S_{C1}$, $S_{C2}$ commanding opening of the switch means 34, 35. At the same time, or immediately afterwards, the microcontroller 33 generates a control signal $S_{C3}$ sent to the low-frequency voltage generator 30 so that the latter delivers a low-frequency (amplitude and/or frequency modulated) signal for energization to the resonant circuit, after which the transmission coil 20 transmits the interrogation signal.

The central processing unit 3 thereafter returns to the initial idle state (switch means 34, 35 closed again).

Thanks to the invention, the control unit 3 necessitates only two connecting terminals 36, 37 for electrically connecting it to the corresponding two terminals 25, 26 of the communication module 2 via the two wires 4 and 5. Thus the two wires 4, 5 are used either to supply power to the module at the DC voltage and consequently to enable monitoring of activation of the control button or to pass the low-frequency signal for energization for transmission of the interrogation Signal. Capacitors 38, 39 are advantageously provided between the low-frequency generator 30 and the switch means 34, 35 to prevent current flowing to the generator 30 when these switch means are in the closed position.

FIG. 3 shows a variant of the central processing unit 3, or to be more precise of the sensing circuit. Here the current measuring means 31 from FIGS. 2 and 3 have been replaced by a resistor 31' in series between the first wire 4 and the connecting terminal connected to the DC power supply $+V_{CC}$. With the resistor 23 of the module 2, this resistor 31' forms a divider bridge. Monitoring the voltage at the terminals of this resistor 31' therefore makes it possible to sense the open or closed state of the pushbutton switch. To be more precise, when the pushbutton switch 22 is in the open state, the voltage $V_I$ at the terminals of this resistor is equal to the DC voltage $+V_{CC}$. Conversely, when the pushbutton switch is in the closed state through manual actuation by a user, the voltage $V_I$ at the terminals of the resistor 31' is given by the following equation, in which $R_3$ is the value of the resistor 31':

$$V_I=V_{CC}[R_2/(R_2+R_3)]$$

As in the sensing circuit from FIGS. 1 and 2, a two-input voltage comparator 32 receiving the voltage $V_I$ at the terminals of the resistor 31' and a reference voltage, for example the supply voltage $+V_{CC}$, delivers to the microcontroller 33 the output signal representing the open or closed state of the pushbutton switch 22.

The operation of the central processing unit 3 from FIG. 3 is somewhat similar to that explained above:

When the system is idle, i.e. awaiting possible manual actuation of the pushbutton switch, the switch means 35 are commanded to the closed position by the control signal $S_{C2}$.

As soon as the sensing circuit senses a closed state of the pushbutton switch, the microcontroller 33 commands opening of the switch means 35. At the same time, or immediately afterwards, the microcontroller 33 generates a control signal $S_{C3}$ sent to the low-frequency voltage generator 30 for the latter to deliver a low-frequency (amplitude and/or frequency modulated) signal for energization to the resonant circuit, after which the transmission coil 20 transmits the interrogation signal.

The central processing unit 3 then returns to the initial idle state (switch means 35 closed again).

Apart from its simplicity of implementation, the benefit of this variant over that described with reference to FIGS. 1 and 2 lies in the fact that by choosing a sufficiently high value resistor 31' it is possible to dispense with the switch means 34 and consequently with generation of the associated control signal $S_{C1}$. It will be noted that the variant of the central processing unit 3 represented in FIG. 3 is equally suited to controlling the module 2 from FIG. 1 or the module 2 represented in FIG. 2.

The invention claimed is:

1. An electronic communication module for locking/unlocking at least one movable panel of a motor vehicle, comprising:

a resonant circuit tuned to a tuning frequency and including a transmission coil in series with a tuning capacitor, said resonant circuit being configured to transmit a low-frequency interrogation signal at said tuning frequency to a badge or portable identifier; and a manually actuated triggering device actuation of which is employed to trigger the transmission of said interrogation signal, wherein the triggering device is a pushbutton switch connected in series at least with a resistor to form an electrical dipole and said electrical dipole is electrically connected in parallel with all or part of the resonant circuit, wherein only two connecting wires of the electronic communication module are needed to command transmission of the interrogation signal following manual actuation of the pushbutton switch.

2. The electronic communication module as claimed in claim 1, wherein said electrical dipole is electrically connected to the terminals of the tuning capacitor.

3. The electronic communication module as claimed in claim 1, wherein the module is configured to be integrated into a handle of a movable panel of the vehicle.

4. The electronic communication module as claimed in claim 1, further comprising a single printed circuit on which said resonant circuit and the electrical dipole are mounted.

5. The electronic communication module as claimed in claim 1, further comprising a single printed circuit on which only the electrical dipole and the tuning capacitor are mounted.

6. The electronic communication module as claimed in claim 1, further comprising a single printed circuit on which only the resonant circuit and said resistor are mounted.

7. The electronic communication module as claimed in claim 1, wherein the electrical dipole comprises an additional inductor in series with the resistor and the pushbutton switch.

8. A control central processing unit of an electronic communication module adapted to transmit a low-frequency interrogation signal to a badge or portable identifier, the control central processing unit being configured to control the electronic communication module as claimed in claim 1 via an electrical connecting harness with two wires.

9. The central processing unit as claimed in claim 8, further comprising:

a low-frequency voltage generator adapted to be electrically connected to the terminals of the resonant circuit of the electronic communication module via the two wires of the connecting harness for the transmission of said interrogation signal;

a connection to a DC electrical power supply adapted to connect the electronic module to said supply via a first wire of the two wires of the connecting harness;

a sensing circuit adapted to deliver an output signal representing the open or closed state of the pushbutton switch; and a microcontroller receiving the output signal of the sensing circuit and adapted, when the sensing circuit senses a closed state of the pushbutton switch, to command generation by said low-frequency voltage generator of a low-frequency signal for energization of the resonant circuit.

10. The central processing unit as claimed in claim 9, wherein the sensing circuit includes means for measuring the current flowing between said first wire and the connection to the DC power supply adapted to deliver an output voltage representing said current and a two-input voltage comparator adapted to compare said output voltage with a reference voltage and to deliver said output signal as a function of the comparison.

11. The central processing unit as claimed in claim 10, wherein the current measuring means comprise a current mirror.

12. The central processing unit as claimed in claim 10, further comprising switch means in series with the current measuring means, and wherein the microcontroller is adapted to command opening or closing of the switch means according to whether the pushbutton switch is in the closed or open state, respectively.

13. The central processing unit as claimed in claim 9, wherein the sensing circuit includes a resistor in series between said first wire and the connection to the DC power supply and a two-input voltage comparator adapted to compare a voltage at the terminals of the resistor to a reference voltage and to deliver said output signal as a function of the comparison.

14. A motor vehicle hands-free access system, comprising:

a communication module adapted to transmit a low-frequency interrogation signal to a badge or portable identifier and a central processing unit for controlling the communication module, wherein said communication module is an electronic communication module as claimed in claim 1, the central processing unit is a control central processing unit configured to:

transmit a low-frequency interrogation signal to a badge or portable identifier, to control the electronic communication module via an electrical connecting harness with two wires, and an electrical connecting harness with two wires electrically connecting said control central processing unit to said electronic communication module.

* * * * *